United States Patent [19]

Hisatomi

[11] Patent Number: 4,870,941

[45] Date of Patent: Oct. 3, 1989

[54] EXHAUST GAS RECIRCULATION SYSTEM FOR INTERNAL COMBUSTION ENGINE

[75] Inventor: Masahiro Hisatomi, Yokohama, Japan

[73] Assignee: Nissan Motor Co., Ltd., Yokohama, Japan

[21] Appl. No.: 197,885

[22] Filed: May 24, 1988

[30] Foreign Application Priority Data

May 27, 1987 [JP] Japan ..... 62-80372

[51] Int. Cl.[4] ..... F02M 25/06

[52] U.S. Cl. ..... 123/571; 123/570

[58] Field of Search ..... 123/568, 569, 570, 571

[56] References Cited

U.S. PATENT DOCUMENTS

| | | | |
|---|---|---|---|
| 3,621,825 | 11/1971 | Ojala | 123/570 |
| 4,433,666 | 2/1984 | Masaki et al. | 123/569 |
| 4,462,376 | 7/1984 | Ripper et al. | 123/569 X |
| 4,615,324 | 10/1986 | Choushi et al. | 123/568 |
| 4,690,120 | 9/1987 | Egle | 123/571 |
| 4,715,348 | 12/1987 | Kobayashi et al. | 123/571 |

FOREIGN PATENT DOCUMENTS 54-121117 2/1979 Japan .

61-182450 8/1986 Japan .

*Primary Examiner*—Willis R. Wolfe

*Attorney, Agent, or Firm*—Foley & Lardner, Schwartz, Jeffery, Schwaab, Mack, Blumenthal & Evans

[57] ABSTRACT

An automotive vehicle is equipped with an exhaust gas recirculation system in which a part of exhaust gas is recirculated back to the combustion chambers of the engine. The exhaust gas recirculation system is comprised of an EGR passage through which the exhaust gas flows. An EGR valve is disposed in the EGR passage to control the amount of the recirculated exhaust gas. A temperature sensor is disposed in the EGR passage upstream of the EGR valve to detect the temperature of the recirculated exhaust gas flowing through the EGR passage and output a signal representing the exhaust gas temperature. The signal is input to a control unit which is arranged to cause a warning lamp to light when the exhaust gas temperature detected by the temperature sensor is below a predetermined level, thus achieving diagnosis of abnormality in the exhaust gas recirculation system such as clogging of the EGR passage and failed operation of the EGR valve while preventing thermal damage of the temperature sensor.

8 Claims, 4 Drawing Sheets

EXHAUST GAS RECIRCULATION SYSTEM FOR INTERNAL COMBUSTION ENGINE

BACKGROUND OF THE INVENTION

1. Field of the Invention

This invention relates to improvements in an exhaust gas recirculation system for an internal combustion engine of a vehicle such as an automotive vehicle, and more particularly to a device for diagnose abnormality of the exhaust gas recirculation system such as abnormality of an EGR valve.

2. Description of the Prior Art

Automotive internal combustion engines are equipped with an exhaust gas recirculation (EGR) system as a measure for exhaust emission control, in which a part of exhaust gas is recirculated through an EGR passage back to engine cylinders each having a combustion chamber. In the EGR system, control of the amount of exhaust gas to be recirculated back to the combustion chamber is carried out by an EGR valve operated in accordance with the operating condition of the engine or the vehicle. In such an EGR system, it is necessary to operate the EGR system without trouble by watching as to whether any abnormality arises or not in the EGR valve and the EGR passage through which the recirculated exhaust gas flows.

Such an exhaust gas recirculation system is disclosed, for example, in Japanese Patent Provisional Publication No. 61-182450. In this EGR system, exhaust gas recirculation is carried out by opening the EGR valve under the action of intake vacuum generated in the vicinity of a throttle valve of an engine and introduced into a vacuum chamber of the EGR valve. Additionally, a temperature sensor is disposed downstream of the EGR valve to detect the temperature of the recirculated exhaust gas, thereby achieving diagnosis of abnormality of the EGR system such as clogging of the EGR passage and failed operation of the EGR valve.

However, difficulties have been encountered in such an EGR system in which since the temperature sensor is disposed on the downstream side of the EGR valve taking account of preventing thermal damage of the temperature sensor, the above-mentioned abnormality diagnosis can be precisely carried out when a large amount of exhaust gas is recirculated, but cannot be carried out when a small amount of exhaust gas is recirculated. In other words, in case the amount of the recirculated exhaust gas is smaller, the recirculated exhaust gas has been cooled before reaching the temperature sensor, so that there is nearly no difference in temperature between the upstream and downstream sides of the EGR vlave. This makes difficult to precisely detect clogging of the EGR passage, failed operation of the EGR valve and the like.

It is to be noted that such an arrangement that the temperature sensor is disposed downstream of the EGR valve has been employed in the background of carrying out an exhaust gas recirculation with a large amount of recirculated exhaust gas in order to achieve exhaust emission control, in which consideration has been made to prevent thermal damage of the temperature sensor due to the large amount of the recirculated exhaust gas. Employment of such an arrangement is based on a standard of combustion performance of engines at the beginning of development of the EGR system. Thereafter, under development of a variety of combustion control techniques of engines, improved exhaust emission control has recently become possible without a large amount of recirculated exhaust gas, by using engine controls other than exhaust gas recirculation.

In view of the above, the inventors of the present application have found that the temperature sensor cannot be thermally damaged even in case of being disposed upstream of the EGR valve, in an engine in which a relatively small amount of exhaust gas is recirculated back to the combustion chambers. This has demonstrates that precise diagnosis of abnormality of the EGR system such as of EGR valve will be carried out even if the amount of recirculated exhaust gas is smaller.

SUMMARY OF THE INVENTION

It is an object of the present invention to provide an improved exhaust gas recirculation system for an internal combustion engine which system can certainly detect temperature variation in exhaust gas recirculated back to the combustion chambers of the engine even in case the amount of the recirculated exhaust gas is smaller, thereby accomplishing a precise diagnosis of abnormality of the EGR system such as of an EGR valve while preventing thermal damage of a temperature sensor.

Another object of the present invention is to provide an improved exhaust gas recirculation control system in which a temperature sensor for detecting the temperature of exhaust gas recirculated back to engine combustion chambers is disposed in an EGR passage upstream of the EGR valve.

Thus, an exhaust gas recirculation system for an internal combustion engine, according to the present invention is comprised of an arrangement defining an EGR passage for fluidly connecting an exhaust system and an intake system of the internal combustion engine, in which a part of exhaust gas from the exhaust system can flow through the EGR passage. An EGR valve is disposed in the EGR passage to control the amount of exhaust gas flowing through the EGR passage. A temperature sensor is disposed in the EGR passage upstream of the EGR valve to detect the temperature of exhaust gas flowing through the EGR passage and outputting a signal representing the temperature. Additionally, abnormality of the exhaust gas recirculation system is detected in accordance with the output signal from the temperature sensor.

By virtue of the fact that the temperature sensor is disposed upstream of the EGR valve, a temperature variation of the recirculated exhaust gas can be certainly detected thereby accomplishing precise diagnosis of abnormality in the exhaust gas recirculation system such as clogging of the EGR passage and failed operation of the EGR valve, without causing thermal damage of the temperature sensor.

DETAILED DESCRIPTION OF THE INVENTION

Figure 1:
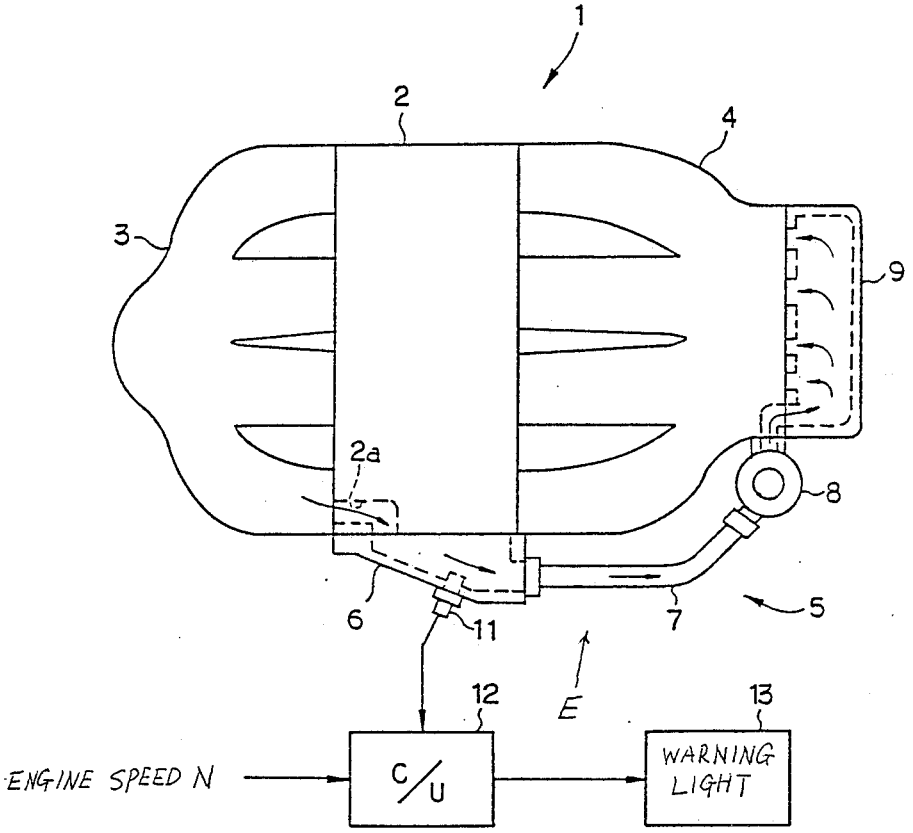
FIG. 1 is a schematic plan view of an automotive internal combustion engine equipped with a preferred embodiment of an exhaust gas recirculation system in accordance with the present invention.
Figure 2:
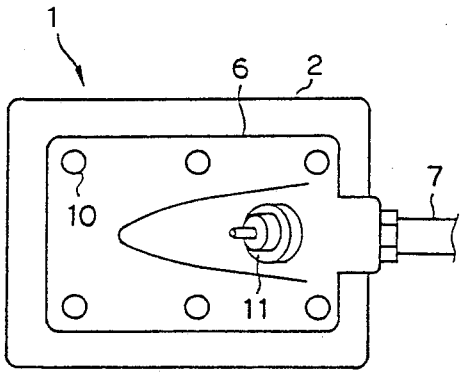
FIG. 2 is a plan view of an EGR cooler to which a temperature sensor is installed, used in the exhaust gas recirculation system of FIG. 1.
Figure 3:
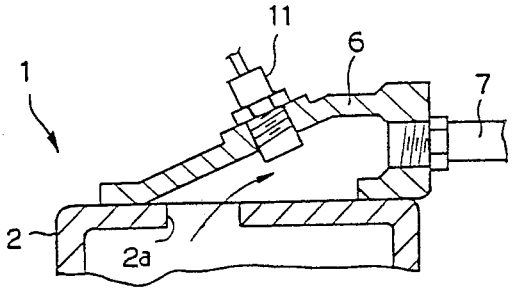
FIG. 3 is a sectional view of the EGR cooler of FIG. 2.

Referring now to FIGS. 1 to 3, there is shown a preferred embodiment of an exhaust gas recirculation (EGR) system E according to the present invention, incorporated with an internal combustion engine 1 of the in-line four cylinder type. The engine 1 includes a cylinder head 2 provided with an exhaust manifold 3 and an intake manifold 4 as usual. The exhaust manifold 3 forms part of an exhaust system of the engine 1 and is communicable through exhaust ports (not shown) with engine cylinders each defining therein a combustion chamber. The intake manifold 4 forms part of an intake system of the engine 1 and is communicable through intake ports (not shown) with the engine cylinders. The exhaust manifold 3 is communicable through an EGR passage 5 with the intake manifold 4 in order that a part of exhaust gas is recirculated or fed back to the intake manifold 4 through the EGR passage 5.

The EGR passage 5 is formed through an EGR cooler 6, an EGR tube 7, an EGR valve 8 and an EGR manifold 9 which are securely connected in such a manner as shown in FIG. 1. The EGR cooler 6 is positioned at the side of the cylinder head 2 and fixedly secured to the side surface of the cylinder head 2 by means of a plurality of bolts 10 as shown in FIG. 2. The inside hollow of the EGR cooler 6 forms part of the EGR passage 5 and is communicated with a small passage 2*a* formed in the cylinder head 2. The small passage 2*a* is communicated with the exhaust manifold 3, so that a part of exhaust gas from the exhaust manifold 3 is introduced through the small passage 2*a* to the inside hollow of the EGR cooler 6. The EGR tube 7 forms part of the EGR passage 5 and securely connected at its one end with the EGR cooler 6. It is to be noted that the sectional area of the EGR passage 5 is enlarged at a location from the small passage 2*a* to the EGR cooler, so that the exhaust gas from the exhaust manifold 3 is expanded and cooled when introduced to the inside hollow of the EGR cooler 6. The temperature of the exhaust gas within the EGR cooler 6 is lower than that within the exhaust manifold 3. The thus cooled exhaust gas is introduced into the EGR tube 7.

The EGR tube 7 is securely connected at the other end thereof with the EGR valve 8 in which a part of the EGR passage 5 is formed. The EGR valve 8 is fixedly secured to the intake manifold 4 in such a manner that a part of the EGR passage 5 is formed in a part of all of the intake manifold 4. The EGR manifold 9 is also secured to the intake manifold 4 and has an inside hollow forming part of the EGR passage 5. The inside hollow of the EGR manifold 9 is communicated with the EGR valve 8 through the EGR passage 5 formed in the wall of the intake manifold 4. The EGR manifold 4 functions to distribute the exhaust gas supplied thereto into the respective branch runners (no numerals) of the intake manifold 4.

A temperature sensor 11 is installed to the EGR cooler 6 in such a manner that its tip end projects into the inside hollow of the EGR cooler 6 to detect the temperature of exhaust gas within the EGR cooler 6. It is to be noted that the temperature sensor 11 is disposed in the EGR passage 5 upstream of the EGR valve 8. In this connection, an EGR rate (a rate of the amount of recirculated exhaust gas relative to the amount of intake air) of the engine 1 is lower than a predetermined level, so that the temperature of the recirculated exhaust gas on the upstream side of the EGR valve 8 is relatively low. The temperature sensor 11 functions to detect the temperature of the cooled exhaust gas passing through the EGR cooler 6 and to output a signal representing the exhaust gas temperature. The output signal is fed to a control unit 12. The EGR valve 8 has a movable valve member (not shown) which is movable in accordance with the difference between atmospheric pressure and intake vacuum on the upstream side of a throttle valve (not shown) of the engine 1. The valve member of the EGR valve 8 is movably disposed in the EGR passage 5 to open or close the EGR passage 5 thereby to control the amount of the exhaust gas recirculated back to the engine cylinders thus controlling the EGR rate in accordance with engine operating conditions. The control unit 12 functions to carry out diagnosis of finding an abnormality such as failed operation of the EGR valve 8, clogging of the EGR passage 5 in accordance with the output signal from the temperature sensor 11. When the control unit 12 makes a judgement of an abnormality occuring, it causes a warning lamp 13 to light in order to inform an operator of the occurrence of the abnormality.

The manner of operation of the EGR system E will be discussed hereinafter.

When intake vacuum on the upstream side of the throttle valve becomes above a predetermined level in a predetermined engine operating condition or vehicle cruising condition, the EGR valve is opened so as to carry out exhaust gas recirculation in which a part of exhaust gas from the exhaust manifold 3 flows as indicated by arrows in FIGS. 1 and 3. At this time, the temperature of the recirculated exhaust gas within the EGR cooler 6 is being watched, making such a judgement that normal exhaust gas recirculation is carried out when the exhaust gas temperature detected by the temperature sensor 11 is not lower than a predetermined level (slice level temperature $T_S$). On the contrary, in case the exhaust gas temperature is below the predetermined level, the exhaust gas temperature around the temperature sensor 11 does not sufficiently arise regardless of the fact that the EGR valve 8 is opened. This leads to such a judgement that no exhaust gas recirculation is accomplished through the EGR passage 5, or suitable amount of exhaust gas is not recirculated, thereby making diagnosis of clogging of EGR passage 5 occurring. Accordingly, the control unit 12 causes the warning lamp 13 to light thereby informing the operator occurence of an abnormality. Consequently, the operator will make a suitable treatment such as checking and servicing. When the exhaust gas temperature detected by the temperature sensor 11 is below the predetermined level, it is also judged that the EGR valve 8 is not opened regardless of an engine operating condition requiring exhaust gas recirculation, in addition to the above-mentioned judgements. This judgement is made by comparing a present (actual) engine operataing or vehicle cruising region and a predetermined vehicle operating region requiring exhaust gas recirculation. The present engine operating or vehicle crusing region can be detected, for example, by engine speed N of the engine 1.

Figure 4:
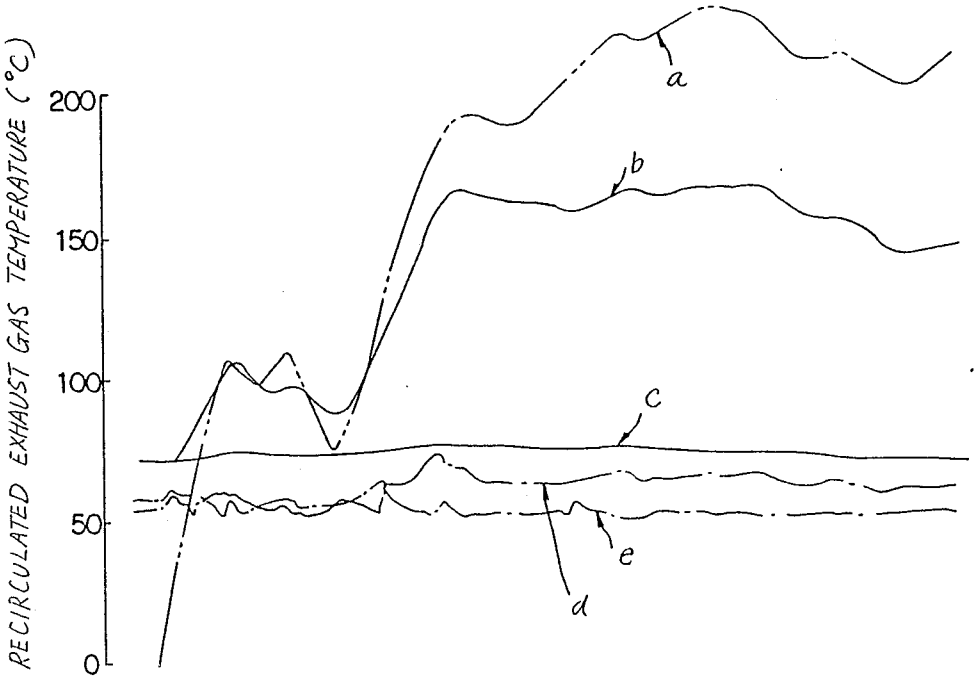
FIG. 4 is a graph showing temperature variations of recirculated exhaust gas in a variety of cases.

Here, FIG. 4 shows an example of temperatures of the recirculated exhaust gas in the predetermined vehicle operating region in which exhaust gas recirculation is carried out, in which vehicle speed is used as a parameter of the operating region. In FIG. 4, a curve a indicates the vehicle speed, a curve b the temperature of the recirculated exhaust gas on the upstream side of the EGR valve 8 in case the EGR valve is fully opened, a curve c the temperature of the recirculated exhaust gas on the upstream side of the EGR valve 8 in case the EGR valve is fully closed, a curve d the temperature of the recirculated exhaust gas on the downstream side of the EGR valve 8 in case the EGR valve is fully opened, and a curve e the temperature of the recirculated exhaust gas on the downstream side of the EGR valve 8 in case the EGR valve is fully closed. As apparent from FIG. 4, the exhaust gas recirculation is carried out in a region in which the EGR valve 8 is fully opened, and there is a difference in temperature of the recirculated exhaust gas between the fully opened and closed conditions of the EGR valve 8. This temperature difference is very large on the upstream side of the EGR valve 8 while small on the downstream side of the EGR valve 8. Additionally, on the downstream side of the EGR valve 8, the temperature of the recirculated exhaust gas is low regardless of fully opened or closed condition of the EGR valve 8. It is to be noted that, in conventional arrangements, a temperature sensor (corresponding to that indicated by the reference numeral 11) is disposed in such a downstream side (a low temperature section) of an EGR valve (corresponding to that indicated by the reference numeral 8), taking account of preventing damage due to high temperature.

However, in recent years, there is a tendency that a required amount of recirculated exhaust gas reduces, and therefore it is difficult to make diagnosis of occurence of abnormality in EGR system E by the conventional arrangements in which the temperature sensor is disposed downstream of the EGR valve because temperature difference between the fully opened and closed conditions of the EGR valve is smaller on the downstream side of the EGR valve 8. In such a background, according to the present invention, the temperature sensor 11 is disposed on the upstream side of the EGR valve 8 upon paying attention on the fact that there is a sufficient temperature difference between the fully opened and closed conditions of the EGR valve 8 in a location on the downstream side of the EGR valve 8, thus enabling to accomplish diagnosis of abnormality in the EGR system E. In this connection, it will be seen that heat resistance seems to be required for the temperature sensor 11. This theme will be discussed hereinafter with reference to FIG. 5.

Figure 5:
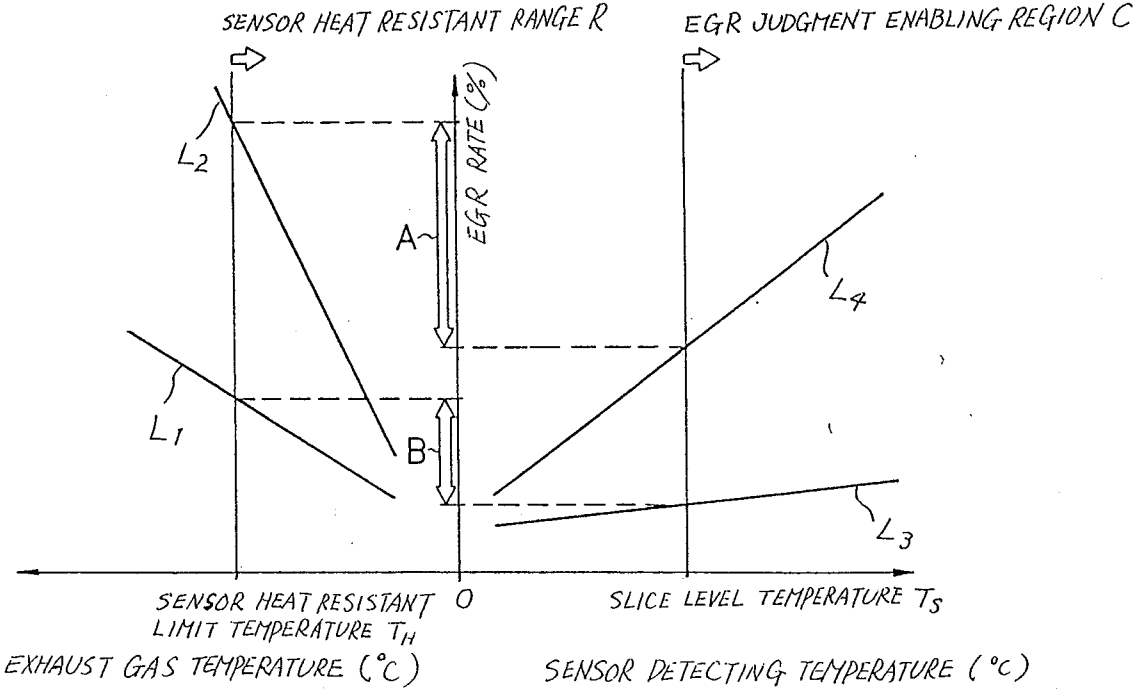
FIG. 5 is a graph showing the relationship between exhaust gas temperature and sensor detecting temperature in terms of EGR rate in various cases.

FIG. 5 shows sensor heat resistant range R of the temperature sensor 11 and a judgment enabling region C in relation to the EGR rate, under a condition in which the EGR valve 8 is fully opened. The temperature sensor 11 has a sensor heat resistance limit temperature $T_H$ (above which the sensor thermally damages) same as that in conventional EGR systems. It will be understood that the heat resistant range R is below the sensor heat resistance limit temperature $T_H$, and the temperature sensor 11 can exhibit its function without thermal damage in the sensor heat resistant range R. A line $L_1$ indicates the recirculated exhaust gas temperature C°) in the EGR passage 5 upstream of the EGR valve 8, whereas a line $L_2$ indicates the same temperature in the EGR passage 5 downstream of the EGR valve 8. As apparent from FIG. 5, even in this sensor heat resistant range R, the upstream and downstream sides of the EGR valve 8 are different in the EGR rate in which the temperature sensor 11 does not thermally damage. Thus, this EGR rate is otherwise used as a parameter for deciding the upper limit of heat resistance of the temperature sensor 11. Additionally, if the EGR rate is too low, the judgement temperature or slice level temperature $T_S$ necessary for diagnosis of abnormality of the EGR valve 8 and the like cannot be obtained. A region higher than the slice level temperature $T_S$ becomes an EGR judgement enabling region C in which diagnosis of abnormality in the EGR system E can be accomplished. The EGR rate is otherwise used as a parameter for deciding the lower limit of the judgment enabling region of the temperature sensor 11. In FIG. 5, a line $L_3$ indicates a sensor detecting temperature (temperature detected by the temperature sensor 11) on the upstream side of the EGR valve 8 in terms of the EGR rate (%), whereas a line $L_4$ indicates the sensor detecting temperature on the downstream side of the EGR valve 8.

As a result, abnormality diagnosis is enable in a region A in FIG. 5 in the case of the downstream side of the EGR valve 8, while in a region B in FIG. 5 in case of the upstream side of the EGR valve 8. The region B demonstrates that the abnormality diagnosis is sufficiently possible even in case of a low EGR rate. Accordingly, in the engine 1 of this embodiment in which the EGR rate is lower, it is possible to precisely judge abnormality in the EGR system E such as failed operation of EGR valve 8, clogging of EGR passage 5 and the like. While lines $L_1$, $L_2$, $L_3$ and $L_4$ are shown in the form of straight line for the purpose of facilitating explanation, they are practically slightly curved, in which they well correspond to actual tendency thereby to sufficiently demonstrate the advantageous effect of the present invention.

What is claimed is:

1. An exhaust gas recirculation system for an internal combustion engine, comprising:

means defining an EGR passage for fluidly connecting an exhaust system and an intake system of the internal combustion engine, a part of exhaust gas from the exhaust system being capable of flowing through said EGR passage;

an EGR valve disposed in said EGR passage to control amount of exhaust gas flowing through said EGR passage; and means for detecting abnormality in said exhaust gas recirculation system in accordance with temperature of exhaust gas flowing through said EGR passage, said abnormality detecting means including a temperature sensor for detecting said temperature and outputting a signal representing said temperature, said temperature sensor being disposed in said EGR passage upstream of said EGR valve.

2. An exhaust gas recirculation system as claimed in claim 1, wherein said EGR passage defining means includes an EGR cooler secured to the engine and defining therein an inside hollow forming part of said EGR passage, said inside hollow being located upstream of said EGR valve.

3. An exhaust gas recirculation system as claimed in claim 2, wherein said temperature sensor is fixedly secured to said EGR cooler so as to project into said inside hollow.

4. An exhaust gas recirculation system as claimed in claim 2, wherein said EGR passage defining means includes an EGR tube for fluidly connecting said EGR cooler and said EGR valve.

5. An exhaust gas recirculation system as claimed in claim 1, wherein said EGR passage defining means includes an EGR manifold for distributing exhaust gas into branch runners of an intake manifold, said EGR manifold being disposed between said EGR valve and said intake manifold.

6. An exhaust gas recirculation system as claimed in claim 1, wherein abnormality detecting means includes means for producing warning for an operator upon receiving a warning signal, and a control unit for outputting said warning signal to the warning means in accordance with the output signal from said temperature sensor.

7. An exhaust gas recirculation system as claimed in claim 6, wherein said control unit is arranged to output said warning signal when said temperature detected by said temperature sensor is below a predetermined level.

8. An exhaust gas recirculation system for an internal combustion engine, comprising:

means defining an EGR passage for fluidly connecting an exhaust system and an intake system of the internal combustion engine, a part of exhaust gas from the exhaust system being capable of flowing through said EGR passage, said EGR passage defining means including an EGR cooler secured to the engine and defining therein an inside hollow forming part of said EGR passage, said inside hollow being located upstream of said EGR valve;

an EGR valve disposed in said EGR passage to control amount of exhaust gas flowing through said EGR passage;

a temperature sensor for detecting temperature of exhaust gas flowing through said EGR passage and outputting a signal representing said temperature, said temperature sensor being disposed in said EGR passage upstream of said EGR valve, said temperature sensor being fixedly secured to said EGR cooler so as to project into said inside hollow; and means for detecting abnormality in said exhaust gas recirculation system in accordance with the output signal from said temperature sensor.

* * * * *